US008181892B2

(12) United States Patent
Jäger

(10) Patent No.: US 8,181,892 B2
(45) Date of Patent: May 22, 2012

(54) DISCHARGE DEVICE

(75) Inventor: Anton Jäger, Senden (DE)

(73) Assignee: Anton Jaeger, Senden (DE)

( * ) Notice: Subject to any disclaimer, the term of this patent is extended or adjusted under 35 U.S.C. 154(b) by 1321 days.

(21) Appl. No.: 11/470,278

(22) Filed: Sep. 6, 2006

(65) Prior Publication Data

US 2007/0051833 A1 Mar. 8, 2007

(30) Foreign Application Priority Data

Sep. 7, 2005 (DE) ..... 10 2005 042 503

(51) Int. Cl.
*B05B 15/08* (2006.01)

(52) U.S. Cl. ..... 239/587.5; 239/280.5; 239/587.1; 239/587.2; 239/451; 239/587.6

(58) Field of Classification Search ..... 239/587.5, 239/451, 455, 458, 459, 460, 531, 532, 529, 239/587.6, 587.1, 588, 525, 526, 232, 280, 239/280.5, 281, 14.2; 137/616.5
See application file for complete search history.

(56) References Cited

U.S. PATENT DOCUMENTS

| | | | | | |
|---|---|---|---|---|---|
| 708,693 | A | * | 9/1902 | Bourey | 285/117 |
| 2,331,373 | A | * | 10/1943 | Campbell | 285/119 |
| 2,857,201 | A | * | 10/1958 | Palmer | 239/281 |
| 3,451,628 | A | * | 6/1969 | Kelley | 239/587.5 |
| 3,531,054 | A | * | 9/1970 | Elgas | 239/587.1 |
| 3,861,566 | A | * | 1/1975 | Wentzell | 222/174 |
| 3,897,829 | A | * | 8/1975 | Eason | 169/53 |
| 3,915,382 | A | * | 10/1975 | Davis | 239/195 |
| 4,575,005 | A | * | 3/1986 | Wiebe | 239/195 |
| 4,653,554 | A | * | 3/1987 | Von Meyerinck et al. | 141/387 |
| 4,690,327 | A | * | 9/1987 | Takai et al. | 239/226 |
| 5,360,163 | A | * | 11/1994 | Dupre | 239/14.2 |
| 5,492,148 | A | * | 2/1996 | Goughneour et al. | 137/616.5 |
| 5,594,973 | A | * | 1/1997 | Brusseleers et al. | 15/304 |
| 5,887,800 | A | * | 3/1999 | McClosky | 239/587.1 |
| 5,947,388 | A | * | 9/1999 | Woodruff | 239/532 |
| 6,257,505 | B1 | * | 7/2001 | Wang | 239/526 |
| 6,508,415 | B2 | * | 1/2003 | Wang | 239/526 |
| 6,685,115 | B1 | * | 2/2004 | Hardin | 239/587.1 |
| 6,802,462 | B2 | * | 10/2004 | Gransow et al. | 239/392 |
| 6,889,920 | B2 | * | 5/2005 | Nance et al. | 239/587.1 |
| 7,290,722 | B1 | * | 11/2007 | Ewald | 239/14.2 |

(Continued)

FOREIGN PATENT DOCUMENTS

DE 2304738 1/1973

(Continued)

*Primary Examiner* — Len Tran
*Assistant Examiner* — Trevor E McGraw
(74) *Attorney, Agent, or Firm* — Gifford, Krass, Sprinkle, Anderson & Citkowski, P.C.

(57) ABSTRACT

The invention relates to a discharge device for a cleaning fluid or treatment fluid, in particular to a lance for a high-pressure cleaner, comprising a pivotable head piece and an elongate holder which carries the head piece at its one end and is made at its other end for holding and for remotely controlled pivoting of the head piece, wherein the holder includes a carrier for the holding of the head piece and an actuation member adjustable relative to the carrier for the pivoting of the head piece relative to the carrier, and wherein the carrier and the actuation member extend up to the head piece in an at least approximately axially parallel arrangement, and in particular coaxial arrangement, with the carrier extending inside the actuation member.

17 Claims, 10 Drawing Sheets

U.S. PATENT DOCUMENTS

| | | | | |
|---|---|---|---|---|
| 2002/0035752 | A1* | 3/2002 | Gransow et al. | 4/601 |
| 2002/0071710 | A1* | 6/2002 | Vito | 401/266 |
| 2002/0134864 | A1* | 9/2002 | Goodwin et al. | 239/532 |

FOREIGN PATENT DOCUMENTS

| | | | |
|---|---|---|---|
| DE | 3243378 | | 7/1983 |
| DE | 8801029.5 | | 1/1988 |
| DE | 4142198 | | 4/1993 |
| DE | 4321669 | | 1/1995 |
| DE | 29511403 | U1 | 7/1995 |
| DE | 20205755 | U | 8/2002 |
| DE | 10134061 | | 2/2003 |
| DE | 10316366 | | 11/2003 |
| DE | 202004005160 | U1 | 3/2004 |
| DE | 202004018903 | U1 | 12/2004 |
| EP | 0617644 | | 10/1994 |

* cited by examiner 11
13
17
19
21
23
27
41
43
45

Fig. 2C
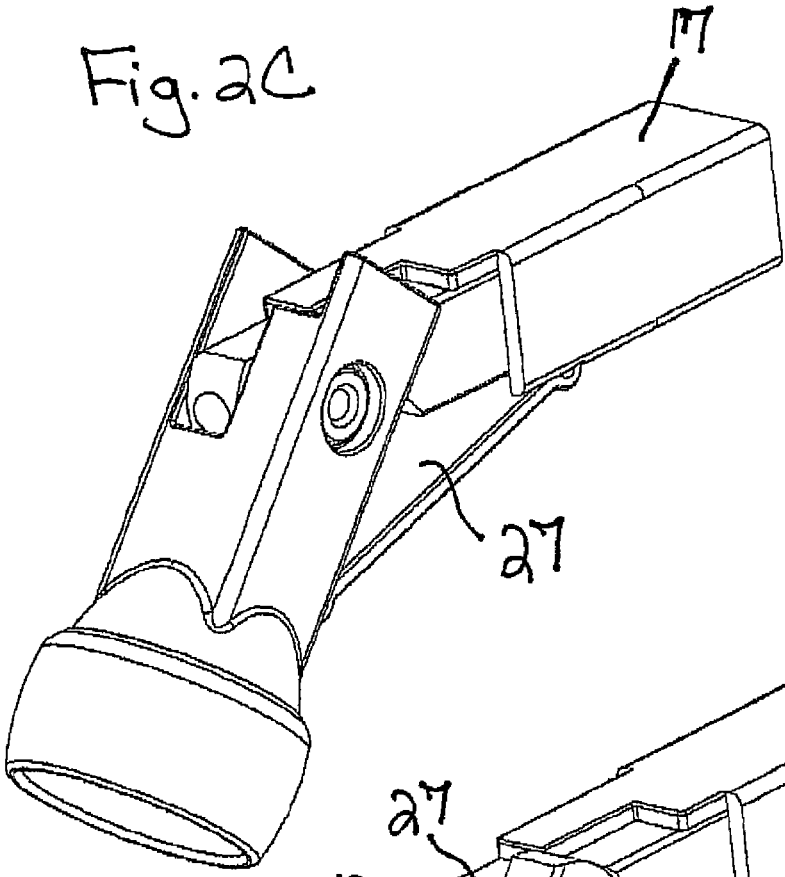
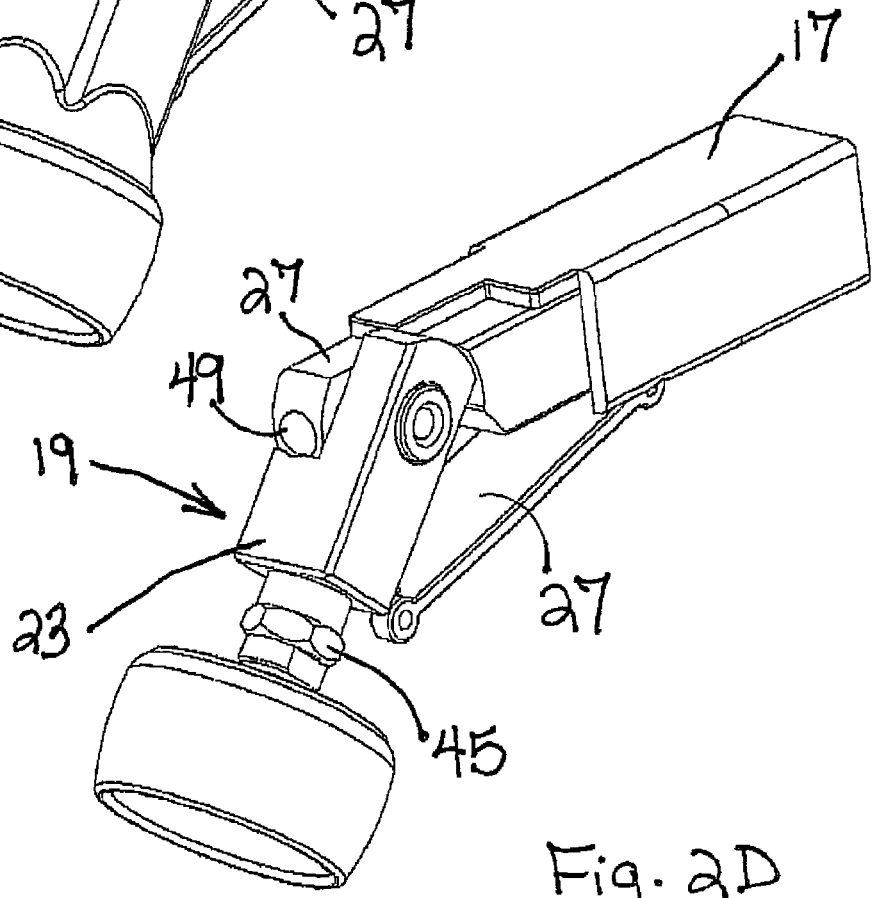
Fig. 2D

DISCHARGE DEVICE

CROSS-REFERENCE TO RELATED APPLICATIONS

This application claims the benefit of German Patent Application No. 10 2005 042 503.8, which was filed on Sep. 7, 2005, and the disclosure of which is incorporated herein by reference.

FIELD

The present disclosure relates to a discharge device for a cleaning fluid or a treatment fluid, in particular to a lance of a high-pressure cleaning device.

BACKGROUND

Discharge devices of this type are generally known, in particular in the form of so-called lances which the user holds at the end facing him with one hand or with both hands and which are provided at their free working end with a nozzle head. The direction in which the cleaning fluid or treatment fluid is discharged via the nozzle head either coincides with the longitudinal axis of the lance or is angled by a fixed dimension with respect to it. It is already known, for example from DE 2 304 738 A1 to couple the nozzle head to an adjustment device. In this manner, the user can adjust the discharge direction of the fluid jet relative to the longitudinal axis of the lance "by remote control" so-to-say.

Lances of this type with a pivotable nozzle head can be used in a variety of applications The user can thus, for example, clean eaves gutters with a downwardly pivoted nozzle head and the underbody of his vehicle with an upwardly pivoted nozzle head without having to turn the lance itself.

SUMMARY

It is the object of the invention to further develop a discharge device of this type with a variable fluid discharge direction such that a simply and reliably operable "remote control" for the varying of the discharge direction is made possible for the user with a simple design of the device not prone to defects.

In accordance with the invention, the carrier holding the head piece runs inside the actuation member. A space-saving and compact design can thereby be achieved. It is furthermore of advantage that exposed transfer elements or adjustment elements can be at least largely avoided by the invention without additional covers and so without any disturbing additional weight. This brings about an enormous improvement in handling for the user, and indeed above all also because there is no risk of "getting caught" at exposed parts somewhere during working. Since a filigree design prone to defects is avoided in accordance with the invention, a robust lance can be realized overall which also functions reliably under adverse conditions.

Preferred embodiments of the invention are also set forth in the dependent claims, in the description and in the drawing.

A relative movement serving for the adjustment of the pivotable head piece between the actuation member and the carrier can consist, in accordance with a variant of the invention, of a displacement of at least one part of the actuation member relative to the carrier. The actuation member can be displaceable as a whole along the carrier.

Alternatively, only a part of the actuation member cooperating directly or indirectly with the head piece can be made as a sliding part which is coupled to an operating section of the actuation member rotatable relative to the carrier. This is so-to-say a hybrid solution in which, to rotate the head piece, the user carries out a rotary movement, in particular around a longitudinal axis of the holder, but the movement of the actuation member responsible for the pivoting of the head piece is a sliding movement, that is a translation movement, in particular along the longitudinal axis of the holder.

In a further alternative aspect, the actuation member as a whole can be rotatable relative to the carrier, in particular around a longitudinal axis of the holder, with this rotary movement being converted directly or indirectly into the pivot movement of the head piece.

The conversion of the rotary movement into the pivot movement of the head piece can in particular take place by a transmission. In a simple aspect, the transmission can be, for example, a spiral, helical or screw-shaped control cam at an end-face margin of the actuation member. In another embodiment, the transmission can be provided in the form of a miter gear.

Further areas of applicability of the present disclosure will become apparent from the detailed description provided hereinafter. It should be understood that the detailed description and specific examples, while indicating the preferred embodiment of the present disclosure, are intended for purposes of illustration only and are not intended to limit the scope of the present disclosure.

BRIEF DESCRIPTION OF THE DRAWINGS

FIG. 1 A is a bottom elevational view illustrating a preferred embodiment of the present invention;

FIG. 2C is a front elevational view of the first preferred embodiment of the invention and illustrating the head in a tilted position;

FIG. 2D is a view similar to FIG. 2C, but with parts removed for clarity;

DETAILED DESCRIPTION

Figures 1A, 1B, 1C:
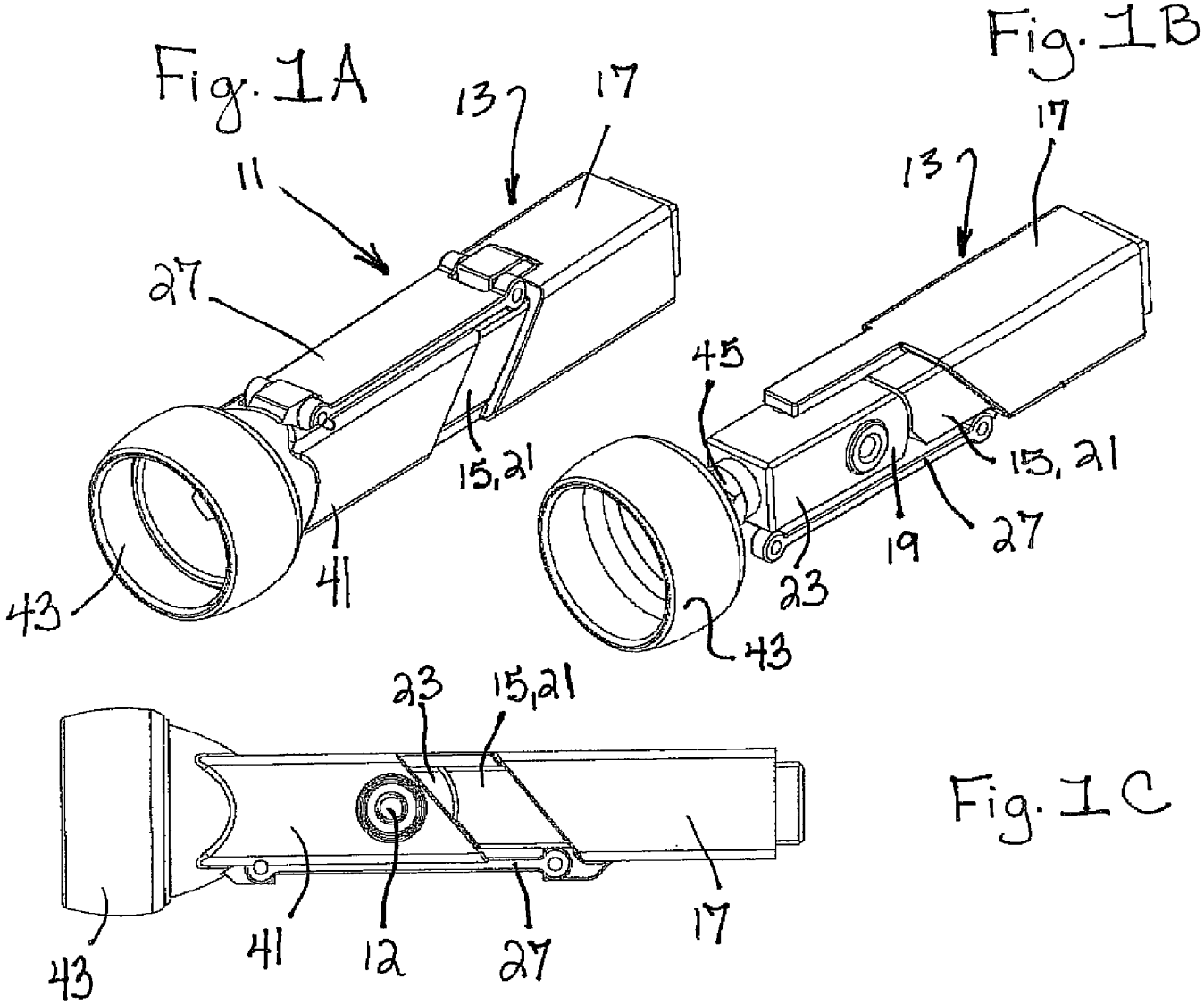
FIG. 1B is a bottom elevational view illustrating the first preferred embodiment of the invention.
FIG. 1C is a plane view of the first preferred embodiment of the present invention.

The following description of the preferred embodiment is merely exemplary in nature and is in no way intended to limit the present disclosure, its application, or uses.

The discharge devices in accordance with the invention are in particular so-called lances for high-pressure cleaning devices. At their end, not shown, facing the user, these lances have an operating part, made e.g. in the form of a pistol trigger, with which the supply of the cleaning fluid to the head region of the lance can be released or interrupted. For this purpose, the lance is connected to a supply line provided e.g. as a hose in the region of this operating part.

The discharge device in accordance with the invention includes a jointed piece 19 which can be flowed through and which has an inlet part 21 and an outlet part 23. Details of this jointed piece 19 are not the subject of the present invention so that they will not be looked at in more detail.

The inlet part 21 of the joint 19 forms the end piece of an elongate holder 13 not shown in full here which is made as a rigid supply line for the cleaning fluid and is also termed a carrier tube in the following. The section of the carrier 15 leading up to the user-side is connected to the inlet part 21 of the joint 19 by suitable means.

The outlet part 23 of the jointed piece 19 is a component of a pivotable head piece 11 and is provided with a nozzle member 45 for the output of the cleaning fluid. The cleaning fluid is supplied via the carrier 15 and its end piece (inlet part) 21, flows through the jointed piece 19 and reaches the nozzle member 45 via the outlet part 23.

Whereas the jointed piece 19 is manufactured from metal, in particular brass, a cover or jacket 41 of the outlet part 23 and a discharge stub 43 surrounding the nozzle member 45 preferably consist of plastic.

The carrier 15, together with at least a part of its end piece forming the inlet part 21 of the joint 19, extends inside an actuation member 17 which is provided in the form of a rigid, elongate sleeve with a square or rectangular cross-section. The arrangement of inwardly disposed carrier 15 and outer actuation member 17 forms an elongate holder for the pivotable head piece 11 whose length can generally be selected as desired.

The preferred embodiment of both the carrier tube 15 and the actuation sleeve 17 as a plastic part in each case results in a weight minimization so that the lance in accordance with the invention also remains easy to handle for the user with a relatively large length.

The actuation sleeve 17 is coupled to the outlet part 23 of the jointed piece 19 by an actuator in the form of a lever 27. The lever 27 is connected at its one end to the end face of the actuation sleeve 17 and at its other end in the region of the end of the outlet part 23 at the nozzle side. By displacement of the actuation sleeve 17 relative to the carrier 15, the head piece 11 is compulsorily guided via the actuation lever 27 and pivoted relative to the longitudinal axis of the holder formed by the carrier 15 and the actuation sleeve 17.

In the extended state in accordance with FIG. 1, i.e. with a pivot angle of 0° between the inlet part 21 and the outlet part 23, the flat actuation lever 27 contacts the outer side of the head piece 11.

The axis of rotation 12 of the joint 19 is arranged somewhat off center with respect to the hinge point of the lever 27 and is therefore disposed more closely to the hinge point at the nozzle side than to the hinge point of the actuation member 17.

The pivoting of the head piece 11 can take place continuously. Alternatively, a latch mechanism only permitting discrete pivot positions can be provided. For this purpose, for example, a latch ball (not shown) pre-tensioned by means of a spring can be arranged in a latch bore 49 (FIG. 2) of the inlet part 21 at the end face which cooperates with a series of latch recesses in the outlet part 23. A latch mechanism can alternatively be effective at the joints of the actuation lever 27.

Figure 3A:
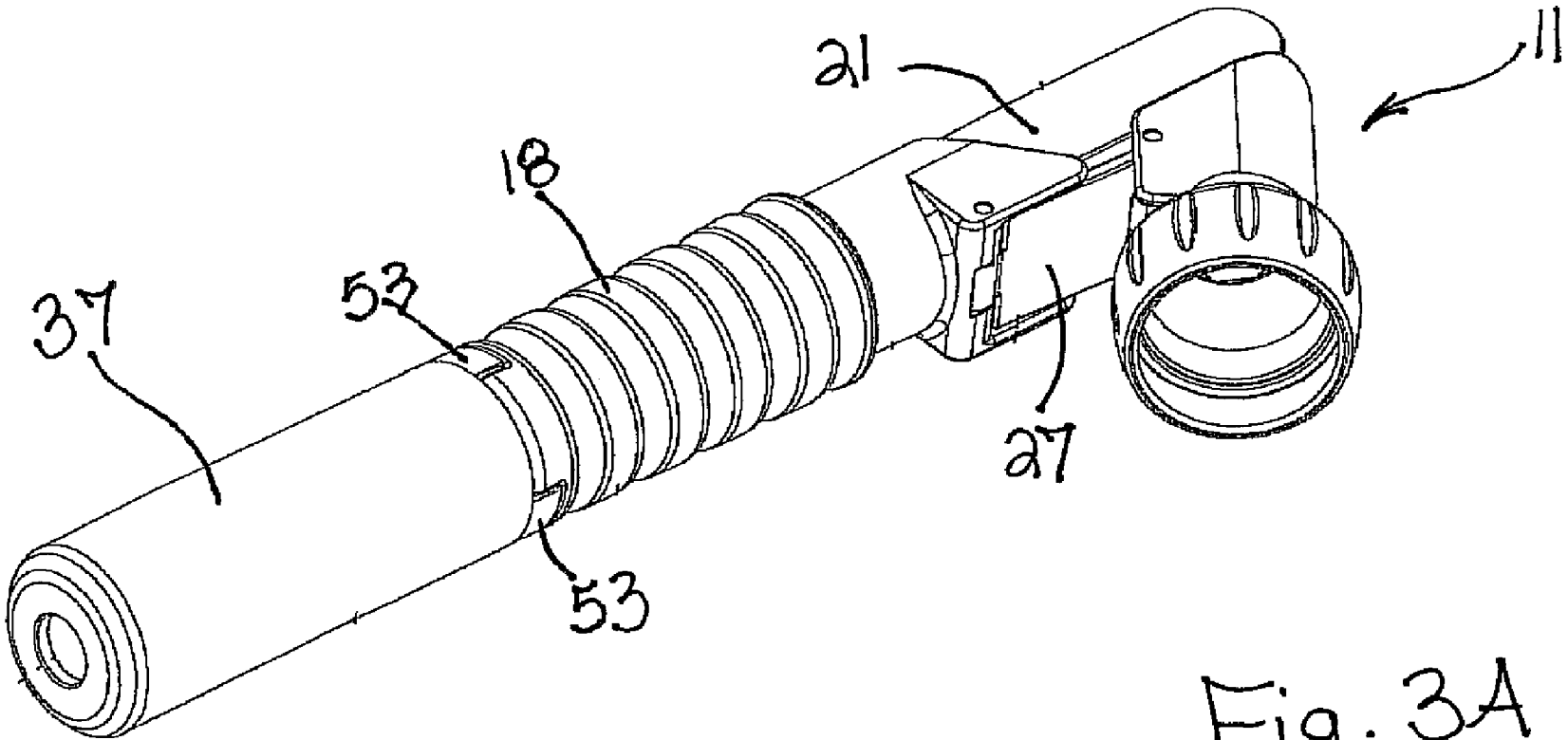
FIG. 3A is an elevational view illustrating a second preferred embodiment of the invention.
Figure 3B:
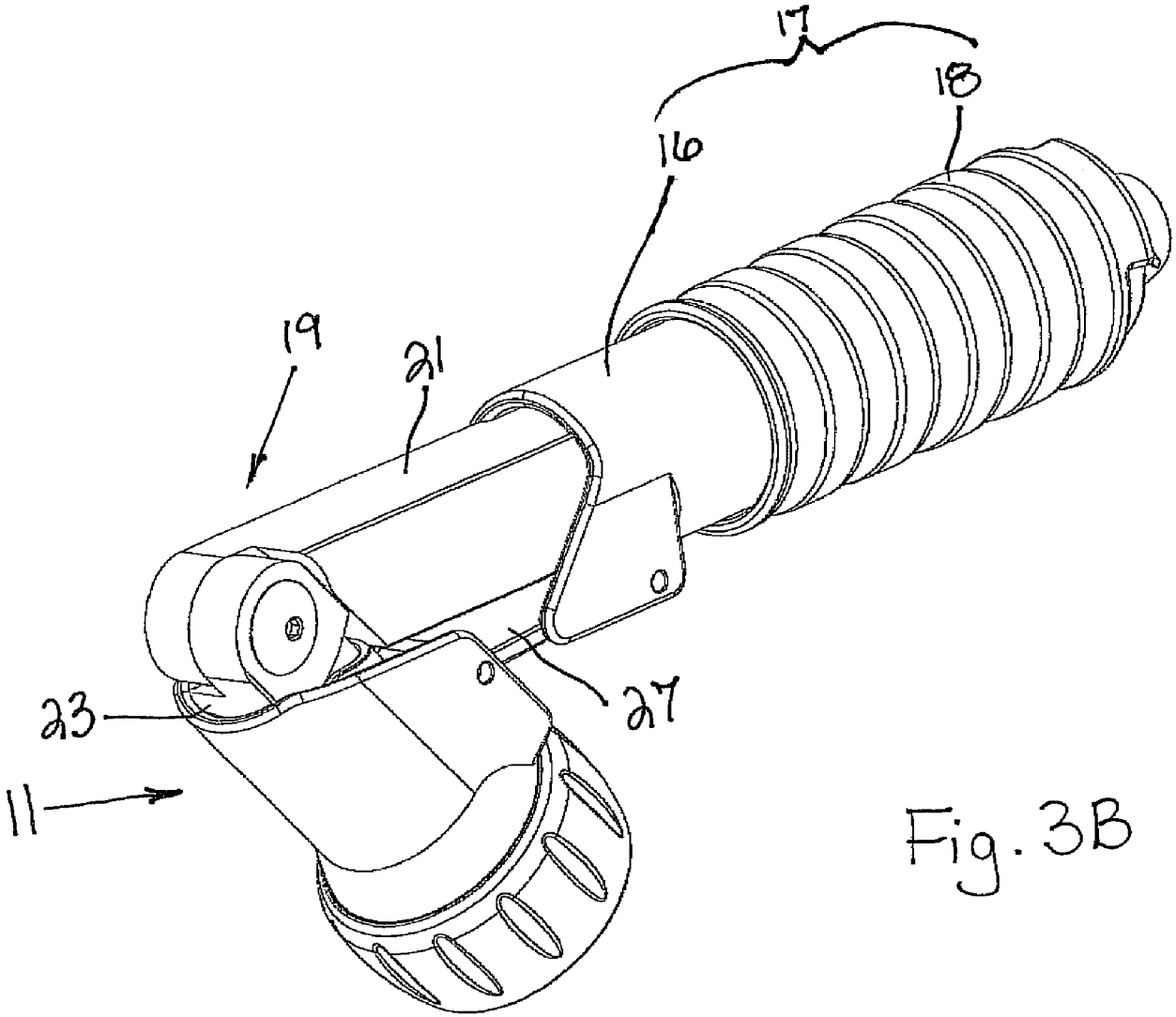
FIG. 3B is a front elevational view illustrating the second preferred embodiment of the present invention.
Figure 4:
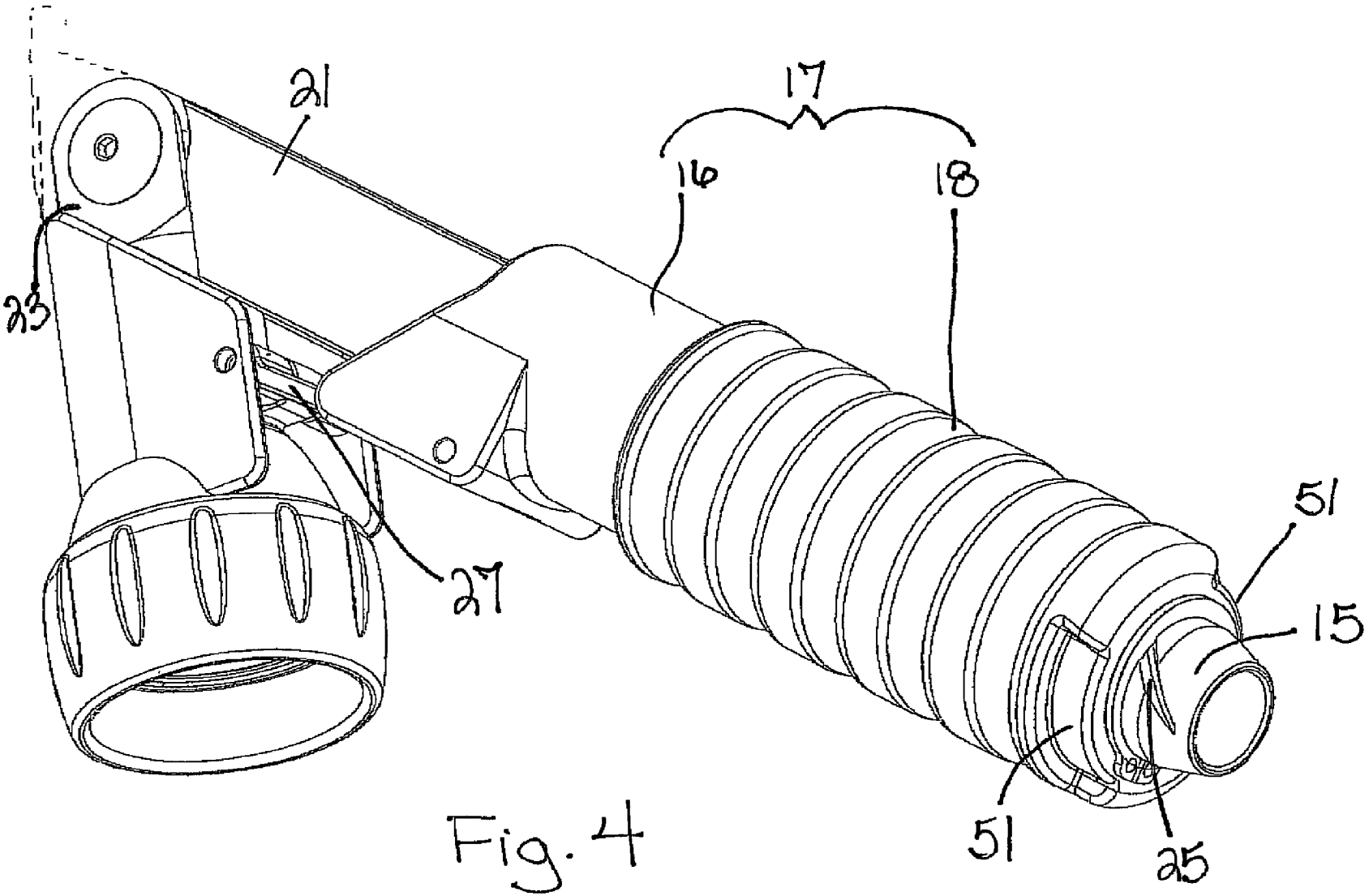
FIG. 4 is a rear elevational view illustrating the second preferred embodiment of the invention.

The embodiment example in accordance with FIGS. 3 and 4 differs from the variant described above in particular by the manner of the actuation of the pivotable head piece 11.

Figures 2A, 2B:
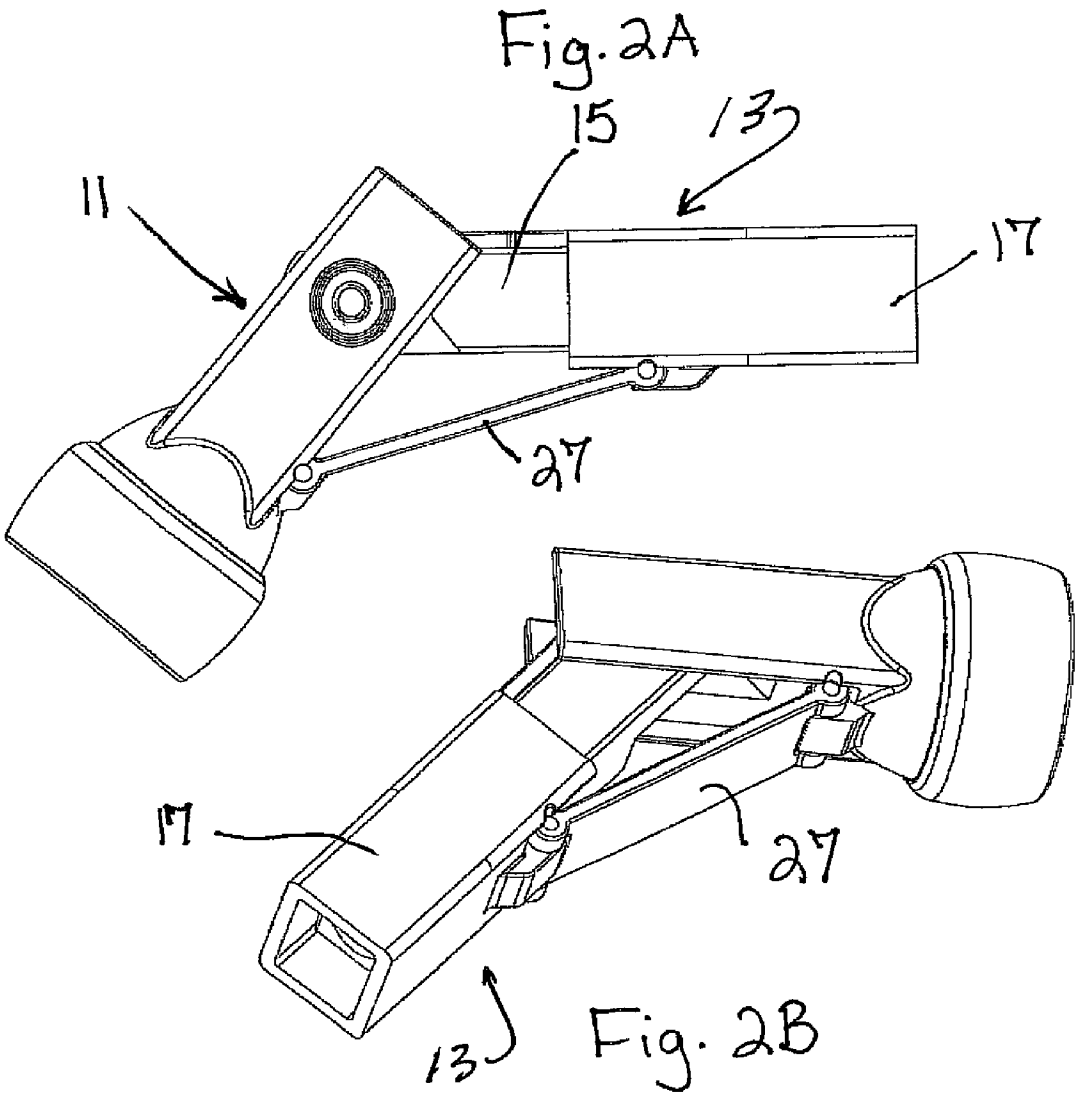
FIG. 2A is a side view of the first preferred embodiment of the invention, but illustrating the head in a tilted position.
FIG. 2B is a bottom elevational view of the first preferred embodiment of the invention and illustrating the head in a tilted position.

The actuation member 17 includes a rotary sleeve 18 which is coupled at its front end to a sliding part 16 which is connected in accordance with the embodiment of FIGS. 1 and 2 via an actuation lever 27 to the head piece 11 or to the outlet part 23 of the jointed piece 19. The rotary sleeve 18 is guided in a compulsory manner on the outer side of the carrier tube 15 to convert a rotary movement into a translatory movement. For this purpose, the carrier tube 15 is provided with an external thread 25 which converts a rotary movement of the rotary sleeve 18 screwed onto the carrier tube 15 in this respect into the displacement movement of the sliding part 16. The fine adjustment of the adjustment mechanism for the pivotable head piece 11 can be directly predetermined by the pitch of the thread 25.

This combined variant of user-side rotation and head-piece-side translation has the advantage that the actuation is made possible by an extremely user-friendly rotation of an operating section (rotary sleeve) 18 while maintaining the constructionally simply and functionally extremely reliable pull/push lever arrangement for the adjustment of the head piece 11. The pivot angle of the head piece 11 can thereby be set without any large expenditure of force and additionally very precisely by means of the rotary sleeve 18.

As in particular the upper representations in FIG. 3 and in FIG. 4 show, the rear end of the operating section 18 is provided with cut-outs 51 into which an extension piece 37 can engage with corresponding engagement sections 53 to establish a rotationally fixed connection to the operating section 18. The lance in accordance with the invention can generally be made as long as desired by the use of a plurality of extension pieces.

Figure 5A:
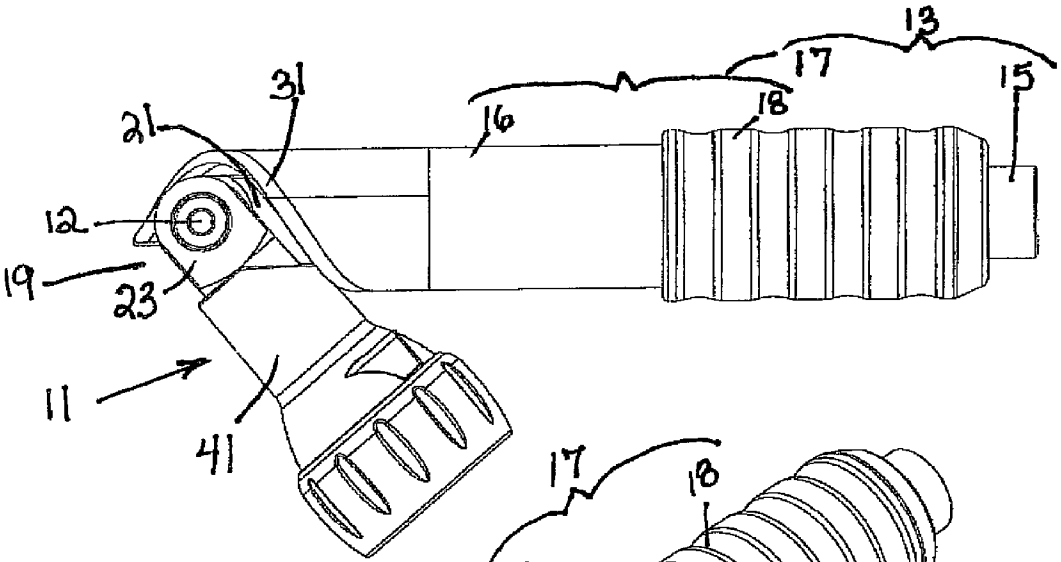
FIG. 5A is a side view illustrating a third preferred embodiment of the present invention.
Figure 5B:
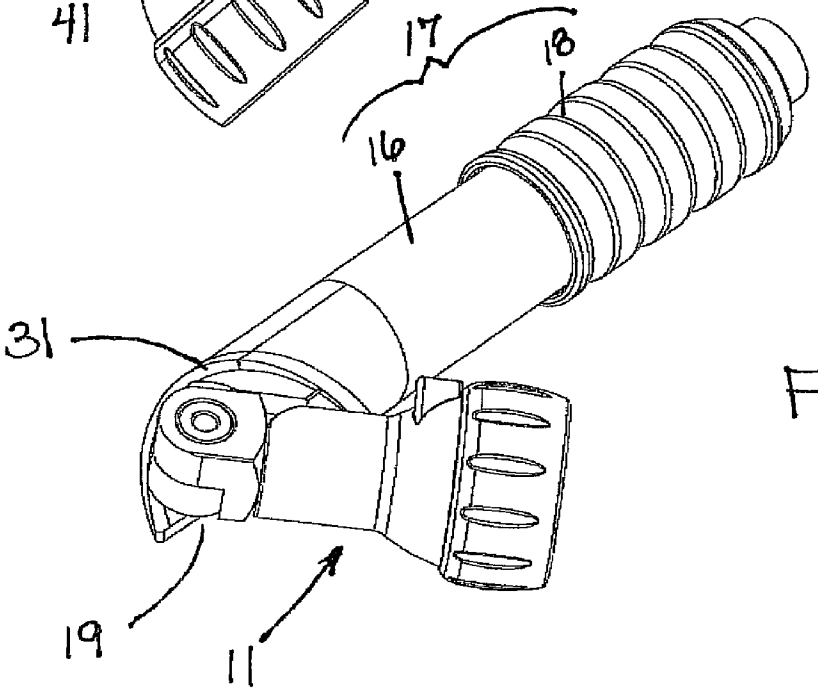
FIG. 5B is an elevational view illustrating the third preferred embodiment of the present invention.

The embodiment shown in FIG. 5 is a purely rotary solution. The actuation member 17 forming the elongate holder 13 of the lance in accordance with the invention together with the carrier tube 15 includes an operating section 18 which is rotatable relative to the carrier 15 together with a control part 16 disposed In front of it.

The front end face of the tubular control part 16 is made as a screw-shaped control cam 31 which cooperates directly with the pivotable head piece 11. The head piece 11—i.e. the outlet part 23 of the joint 19 or its cover or jacket 41—is acted on at a sufficient spacing from the axis of rotation 12 and is pivoted in accordance with the extent of the control cam 31 by rotation of the operating section 18 and thus of the rotary part 16 relative to the carrier 15 and thus to the inlet part 21 of the jointed piece 19.

Figure 6A:
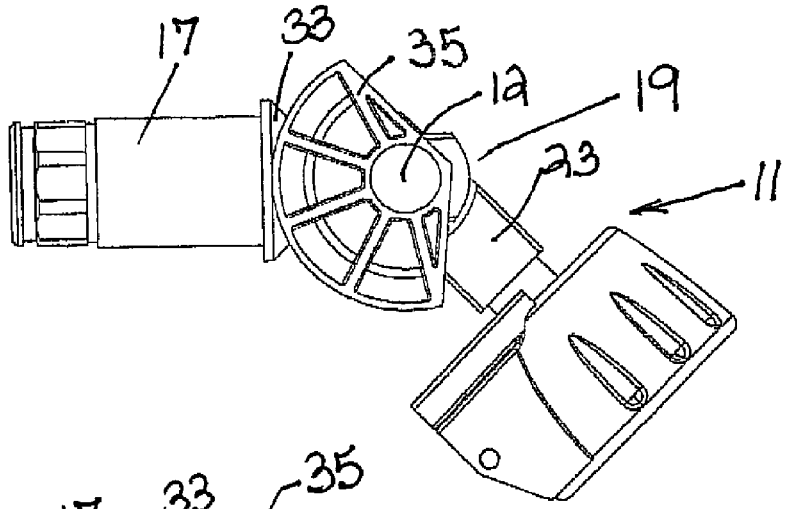
FIG. 6A is a side view of a fourth preferred embodiment of the present invention.
Figure 6B:
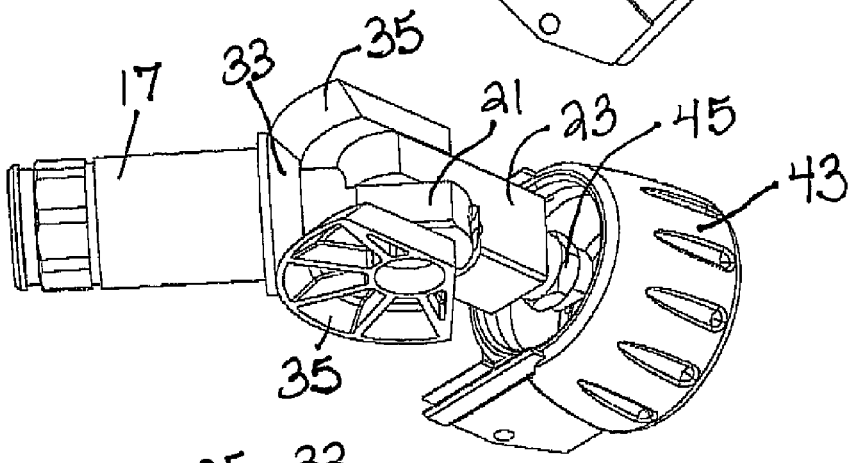
FIG. 6B is a top elevational view illustrating the fourth preferred embodiment of the present invention.
Figure 6C:
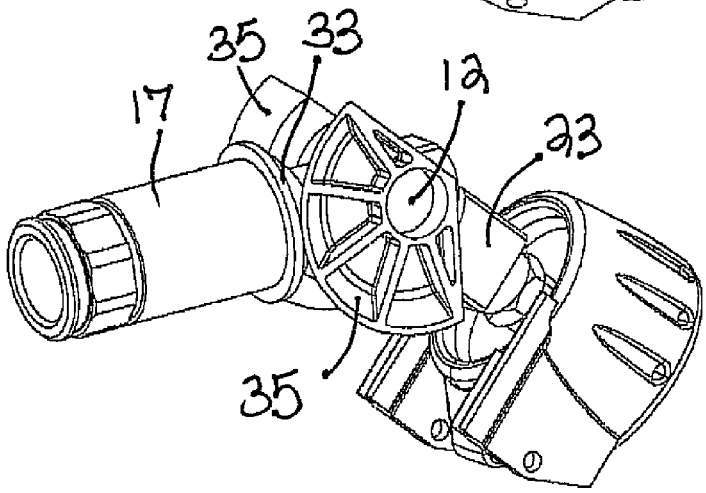
FIG. 6C is a rear side elevational view illustrating the fourth preferred embodiment of the invention.
Figure 7A:
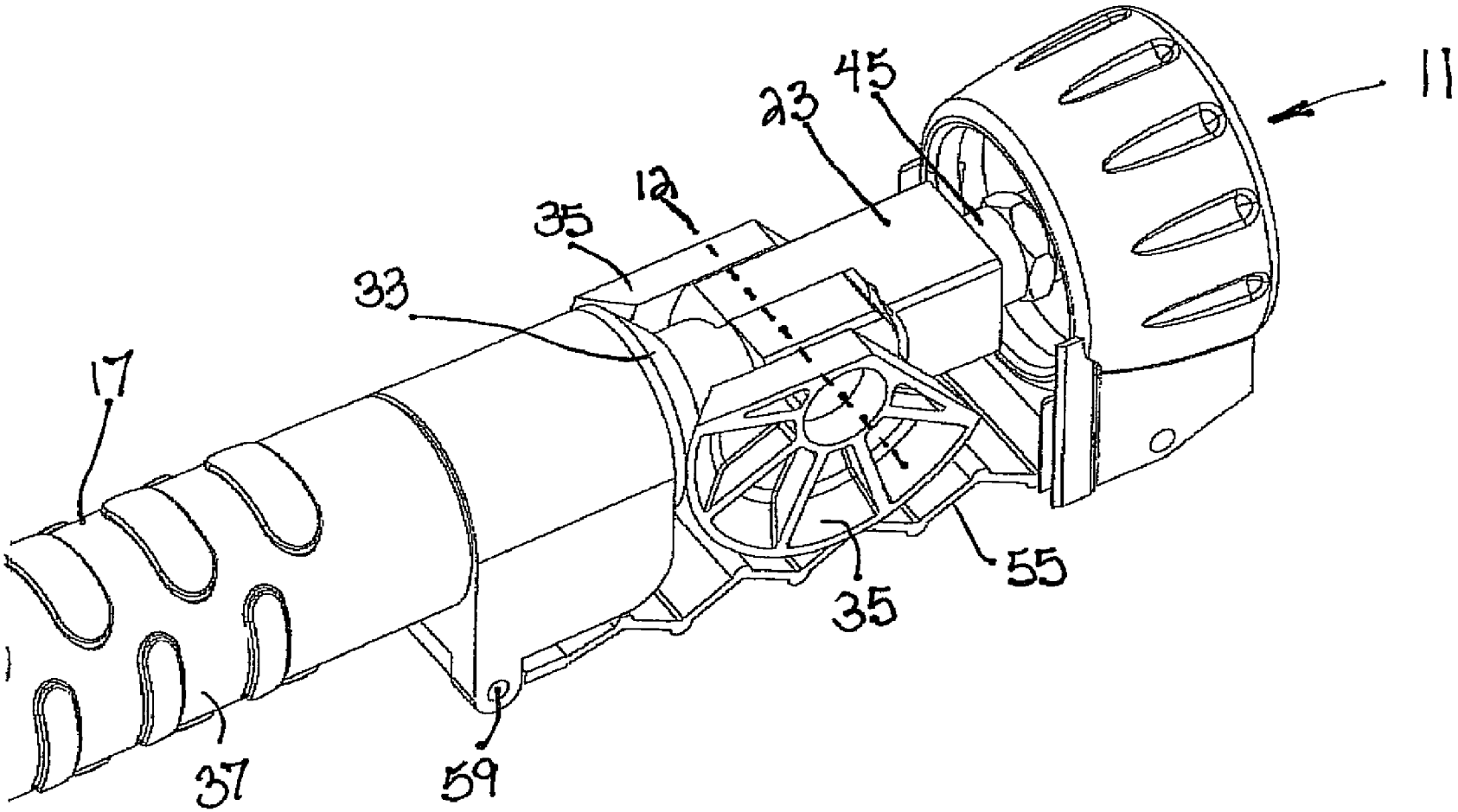
FIG. 7A is a fragmentary top rear elevational view of the fourth preferred embodiment of the invention.
Figures 7B, 7C:
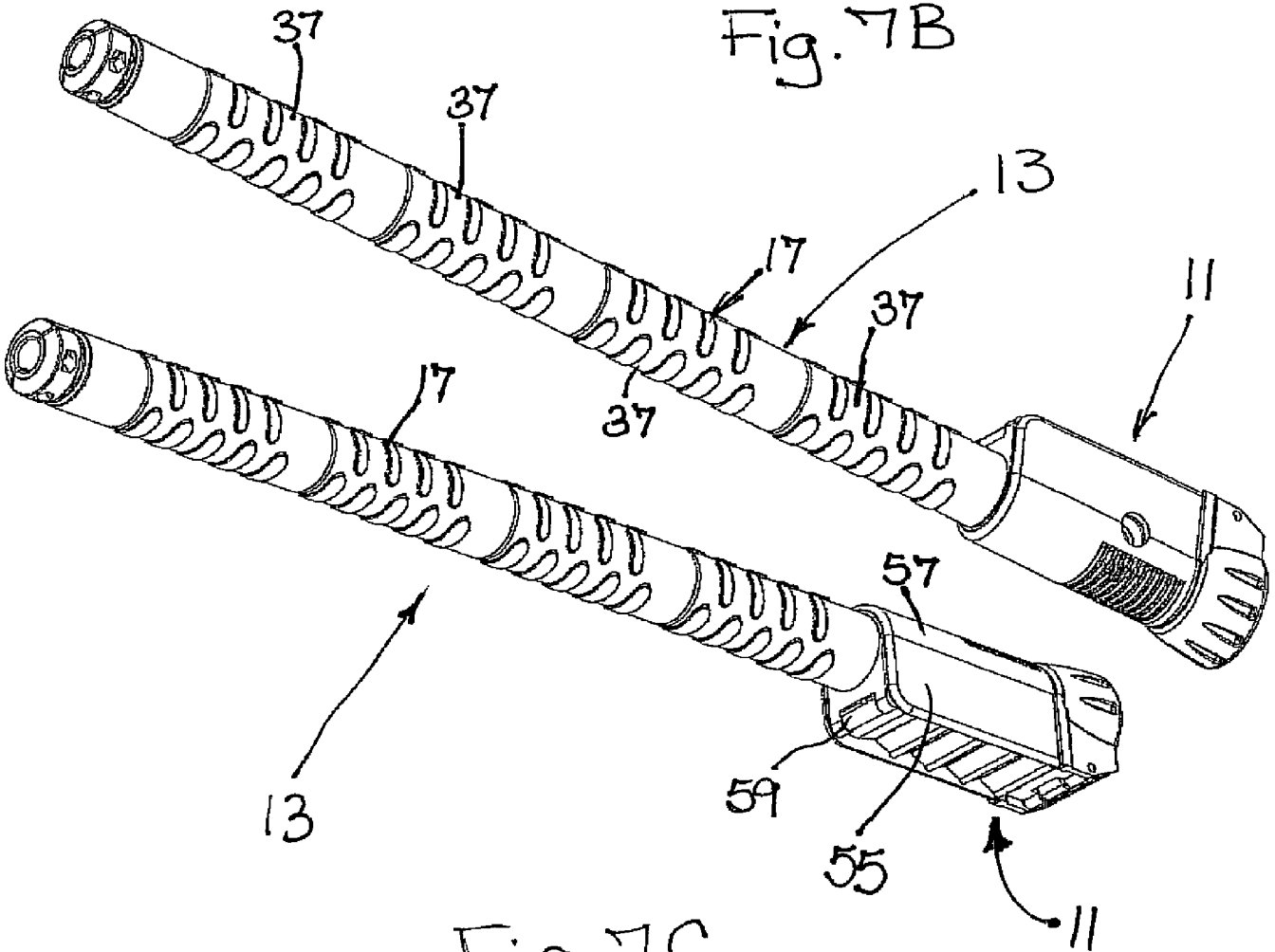
FIG. 7B is a top elevational view of the fourth preferred embodiment of the present invention.
FIG. 7C is a rear elevational view of the fourth preferred embodiment of the invention.

A further purely rotary solution is shown in FIGS. 6 and 7. The actuation member 17 is made at the end face as a miter gear or pinion gear 33 which cooperates with two miter gears or crown gears 35. The crown gears 35 are rotationally fixedly connected to the outlet part 23 of the jointed piece 19 whose inlet part 21 is rotationally fixedly connected to the carrier tube not shown here and extending through the rotatable actuation member 17.

A rotation of the actuation member 17 by the user relative to the carrier and thus to the inlet part 21 thus effects a corresponding pivot movement of the head piece 11 provided with the nozzle member 45 via the miter gear formed by the toothed wheels 33, 35.

FIG. 7 shows the lance in accordance with the invention in the upper illustration partly with a pivotable housing part 55 which is pivoted around an axis 59 on the pivoting of the head piece by means of the miter gear 33, 35.

The two lower illustrations in FIG. 7 show the lance in accordance with the invention in the extended state and with a head piece 11 completely covered by the pivotable housing part 55 and a fixed housing part 57. The miter gear 33, 35 and the jointed piece 19 are ideally protected against external influences by this "all-round cover".

In addition to the part carrying the pinion gear 33 at the end face, the actuation member 17 includes a plurality of extension pieces 37 which can be rotationally fixedly connected to one another and whose number can generally be selected as desired to obtain a lance with the desired working length.

The description of the present disclosure is merely exemplary in nature and, thus, variations that do not depart from the gist of the present disclosure are intended to be within the scope of the present disclosure. Such variations are not to be regarded as a departure from the spirit and scope of the present disclosure.

REFERENCE NUMBER LIST

11 head piece
12 pivot axis
13 holder
15 carrier, tube
16 part of the actuation member
17 actuation member
18 operating section, sleeve
19 jointed piece
21 inlet part
23 outlet part
25 thread
27 actuator, lever
29 transmission
31 control cam
33 miter gear of the actuation member, pinion gear
35 miter gear of the head piece, crown gear
37 extension piece
41 jacket, cover
43 discharge stub
45 nozzle member
49 latch bore
51 cut-out
53 engagement section
55 housing part
57 housing part
59 axis

What is claimed is:

1. A discharge device for a fluid, comprising:

a pivotable head piece (11);

an elongate holder (13), which carries the head piece (11) at its one end and is made at its other end for holding and for remotely controlled pivoting of the head piece (11), wherein the holder (13) comprises:

a carrier (15) for the holding of the head piece (11); and an actuation member (17) adjustable relative to the carrier (15) for the pivoting of the head piece (11) relative to the carrier (15), and wherein the carrier (15) and the actuation member (17) both extend entirely up to the head piece (11) in a substantially axially parallel arrangement with the carrier (15) extending inside and through substantially the entire length of the actuation member (17);

wherein the actuation member (17) is connected via an actuator (27) to a pivotable part (23) of the head piece (11), wherein the actuator includes a lever (27), which is connected to the actuation member (17) at its one end and to the head piece (11) at its other end, and wherein the carrier (15) forms a fluid supply line.

2. A discharge device in accordance with claim 1, wherein the holder (13) is simultaneously made as a fluid supply line for the head piece (11).

3. A discharge device in accordance with claim 1, wherein the head piece (11) includes a jointed piece (19) which can be flowed through by a cleaning fluid and has an inlet part (21) and an outlet part (23) for the cleaning fluid, with the carrier (15) being connected to the inlet part (21).

4. A discharge device in accordance with claim 1, wherein at least one part (16) of the actuation member (17) is displaceable for the pivoting of the head piece (11) relative to the carrier (15).

5. A discharge device in accordance with claim 1, wherein the actuation member (17) includes an operating section (18) which is rotatable relative to the carrier (15) and is coupled to the actuation member (17) and to the carrier (15) such that the rotary movement of the operating section (18) is converted into a displacement movement of a part (16) of the actuation member (17).

6. A discharge device in accordance with claim 5, wherein the operating section (18) and the carrier (15) are coupled via a thread (25).

7. A discharge device in accordance with claim 1, wherein the actuator (27) is connected to the actuation member (17) adjacent the head piece.

8. A discharge device in accordance with claim 1, wherein the actuation member (17) is rotatable relative to the carrier (15) for the pivoting of the head piece (11).

9. A discharge device in accordance with claim 1, wherein the actuation member (17) is provided in the region of its end at the head piece side with a transmission (29), which cooperates with the pivotable head piece (11), in particular with an outlet part (23) of a jointed part (19), which can be flowed through, such that the transmission (29) converts a rotation of the actuation member (17) into a pivot movement of the head piece (11).

10. A discharge device in accordance with claim 9, wherein the transmission (29) includes a control cam (31) which cooperates directly with a pivotable part (23) of the head piece (11).

11. A discharge device in accordance with claim 10, wherein the control cam (31) is formed by the end-face margin of the actuation member (16).

12. A discharge device in accordance with claim 9, wherein the transmission includes a gear transmission (29), in particular a miter gear transmission.

13. A discharge device in accordance with claim 1, wherein an actuation member (16) is provided at the end face with a miter gear (33) aligned in an axially parallel and in particular coaxial manner whose axis of rotation extends perpendicular to the pivot axis (12) of the head piece (11) and cooperates with at least one miter gear (35) of the head piece (11) whose axis of rotation extends parallel to the pivot axis (12) of the head piece (11).

14. A discharge device in accordance with claim 1, wherein the actuation member (17) includes a plurality of extension pieces (37) which can be coupled to one another in a rotationally fixed manner at the end face.

15. A discharge device in accordance with claim 1, wherein at least one jointed piece (19) of the pivotable head piece (11) is manufactured from metal and the holder (13) is manufactured from plastic.

16. A discharge device for a fluid, comprising:

a pivotable head piece (11);

an elongate holder (13), which carries the head piece (11) at its one end and is made at its other end for holding and for remotely controlled pivoting of the head piece (11), wherein the holder (13) comprises:

a carrier (15) for the holding of the head piece (11); and an actuation member (17) adjustable relative to the carrier (15) for the pivoting of the head piece (11) relative to the carrier (15), and wherein the carrier (15) and the actuation member (17) extend up to the head piece (11) in a substantially axially parallel arrangement with the carrier (15) extending inside and through the actuation member (17);

wherein the actuation member (17) is connected via an actuator (27) to a pivotable part (23) of the head piece (11), wherein the actuator includes a lever (27), which is connected to the actuation member (17) at its one end and to the head piece (11) at its other end, and wherein the head piece (11) includes a jointed piece (19) which can be flowed through by a cleaning fluid and has an inlet part (21) and an outlet part (23) for the cleaning fluid, with the carrier (15) being connected to the inlet part (21).

17. A discharge device for a fluid, comprising:

a pivotable head piece (11);

an elongate holder (13), which carries the head piece (11) at its one end and is made at its other end for holding and for remotely controlled pivoting of the head piece (11), wherein the holder (13) comprises:

a carrier (15) for the holding of the head piece (11); and an actuation member (17) adjustable relative to the carrier (15) for the pivoting of the head piece (11) relative to the carrier (15), and wherein the carrier (15) and the actuation member (17) extend up to the head piece (11) in a substantially axially parallel arrangement with the carrier (15) extending inside and through the actuation member (17);

wherein the actuation member (17) is connected via an actuator (27) to a pivotable part (23) of the head piece (11), wherein the actuator includes a lever (27), which is connected to the actuation member (17) at its one end and to the head piece (11) at its other end, and wherein the actuator (27) is connected to the actuation member (17) adjacent the head piece.

* * * * *